US007037064B2

(12) United States Patent
Heiple

(10) Patent No.: US 7,037,064 B2
(45) Date of Patent: May 2, 2006

(54) GRAPPLE ASSEMBLY FOR EXCAVATING MACHINES AND THE LIKE

(75) Inventor: Ashley Heiple, Alum Bank, PA (US)

(73) Assignee: Rockland, Inc., Bedford, PA (US)

( * ) Notice: Subject to any disclaimer, the term of this patent is extended or adjusted under 35 U.S.C. 154(b) by 166 days.

(21) Appl. No.: 10/786,293

(22) Filed: Feb. 26, 2004

(65) Prior Publication Data

US 2005/0191163 A1 Sep. 1, 2005

(51) Int. Cl.
*B66C 1/00* (2006.01)

(52) U.S. Cl. ..... 414/729; 37/406; 414/724; 414/912

(58) Field of Classification Search ..... 414/729, 414/724, 912; 37/403, 406, 903
See application file for complete search history.

(56) References Cited

U.S. PATENT DOCUMENTS 3,353,285 A * 11/1967 Murray ..... 37/406
4,932,832 A * 6/1990 McCasland et al. ..... 414/732
6,203,267 B1 * 3/2001 Heiple et al. ..... 414/722
6,640,471 B1 * 11/2003 Desrochers ..... 37/406
6,857,843 B1 * 2/2005 Cummings et al. ..... 414/729

* cited by examiner

*Primary Examiner*—Donald W. Underwood
(74) *Attorney, Agent, or Firm*—Stevens, Davis, Miller & Mosher, LLP

(57) ABSTRACT

An assembly mountable on a dipper stick of a machine having a tool pivotally connected thereto and means operatively interconnecting the dipper stick and the tool for pivoting the tool relative to the dipper stick, cooperable with the tool for grappling objects, generally consisting of an arm member having a first section connectable to an underside of the dipper stick for pivotal movement about a second axis and a second section connectable to the first section for pivotal movement relative to the first arm section about a third axis, one of the arm sections having a curved bearing surface with a notch therein and the other of the arm sections having a roller biased against the bearing surface whereby the roller may be received in the notch to displaceably position the second arm section relative to the first arm section in a certain relationship, and ride on portions of the curved bearing surface upon a force in a certain direction as being applied to the second arm member causing the roller to ride out of the recess against the biasing force acting thereon; and a chain connected at one end to the second arm section and connectable at an opposite end thereof to the dipper stick.

26 Claims, 3 Drawing Sheets

GRAPPLE ASSEMBLY FOR EXCAVATING MACHINES AND THE LIKE

This invention relates to an arm assembly connectable to the dipper stick of a machine having a tool pivotally connected thereto and means operatively interconnecting such dipper stick and such tool for pivoting the tool, cooperable with the tool for grappling objects between such assembly and the tool. This invention further contemplates an assembly which is operable to displace laterally out of alignment with such tool when a lateral force is applied thereto and to return into alignment with the tool upon removal of such force.

BACKGROUND OF THE INVENTION

In the prior art, there has been developed an assembly consisting of a dipper stick connectable to the boom of a machine such as an excavating machine, a tool typically a bucket, pivotally connected to the dipper stick, a cylinder assembly operatively interconnecting the dipper stick and the tool for pivoting the tool and an arm member mounted on and depending from the underside of the dipper stick, commonly referred to as a "thumb", cooperable with the tool when the tool is pivoted toward the arm member for grappling objects such as trees, logs, large rocks and the like therebetween. Such an assembly is illustrated and described in U.S. Pat. No. 3,613,922.

For such an assembly to operate effectively in performing grappling operations, such arm member should lie in substantially the same vertical plane as the dipper stick and tool and be aligned with the tool to most effectively grapple an object between the tool and the arm member. Often, however, in the operation of such machines, lateral forces may be applied to such arm members which could have the effect of misaligning the arm member with a tool and, with the application of severe forces, possibly breaking the arm member from the dipper stick. Accordingly, it is the principal object of the present invention to provide an arm member of a grappling assembly which will withstand laterally directed impact forces, prevent breakage and restore it in proper alignment with the cooperating tool of the assembly for grappling objects.

SUMMARY OF THE INVENTION

The present invention provides an assembly mountable on the boom of a machine for grappling objects, generally consisting of a dipper stick pivotally connectable to such a boom, a tool connected to the dipper stick pivotal about an axis relative to the dipper stick, means operatively interconnecting the dipper stick and the tool for pivoting the tool about its pivot axis and an arm assembly mountable on the dipper stick and cooperable with the tool as the tool is pivoted relative to the dipper stick to grapple objects therebetween. The arm assembly generally includes an arm member having a first section connected to an underside of the dipper stick for pivotal movement about a second axis and a second section connected to the first arm section for pivotal movement relative to the first arm member about a third axis, one of the arm sections having a curved bearing surface with a notch therein and the other of the arm sections having a biased roller engaging the bearing surface whereby the roller may be received in the notch to displaceably position the second arm member relative to the first arm member and ride on portions of the curved surface when a force in a certain direction is applied to the second arm member; and a chain connectable at one end to the underside of the dipper stick and connected at another end thereof to the arm member. Objects grappled between such an arm assembly and a tool may be engaged by the arm assembly by means of an end of the arm member alone, such chain alone or a combination of the end of the arm member and the chain.

DETAILED DESCRIPTION OF THE PREFERRED EMBODIMENT OF THE INVENTION

Figures 1, 2, 3:
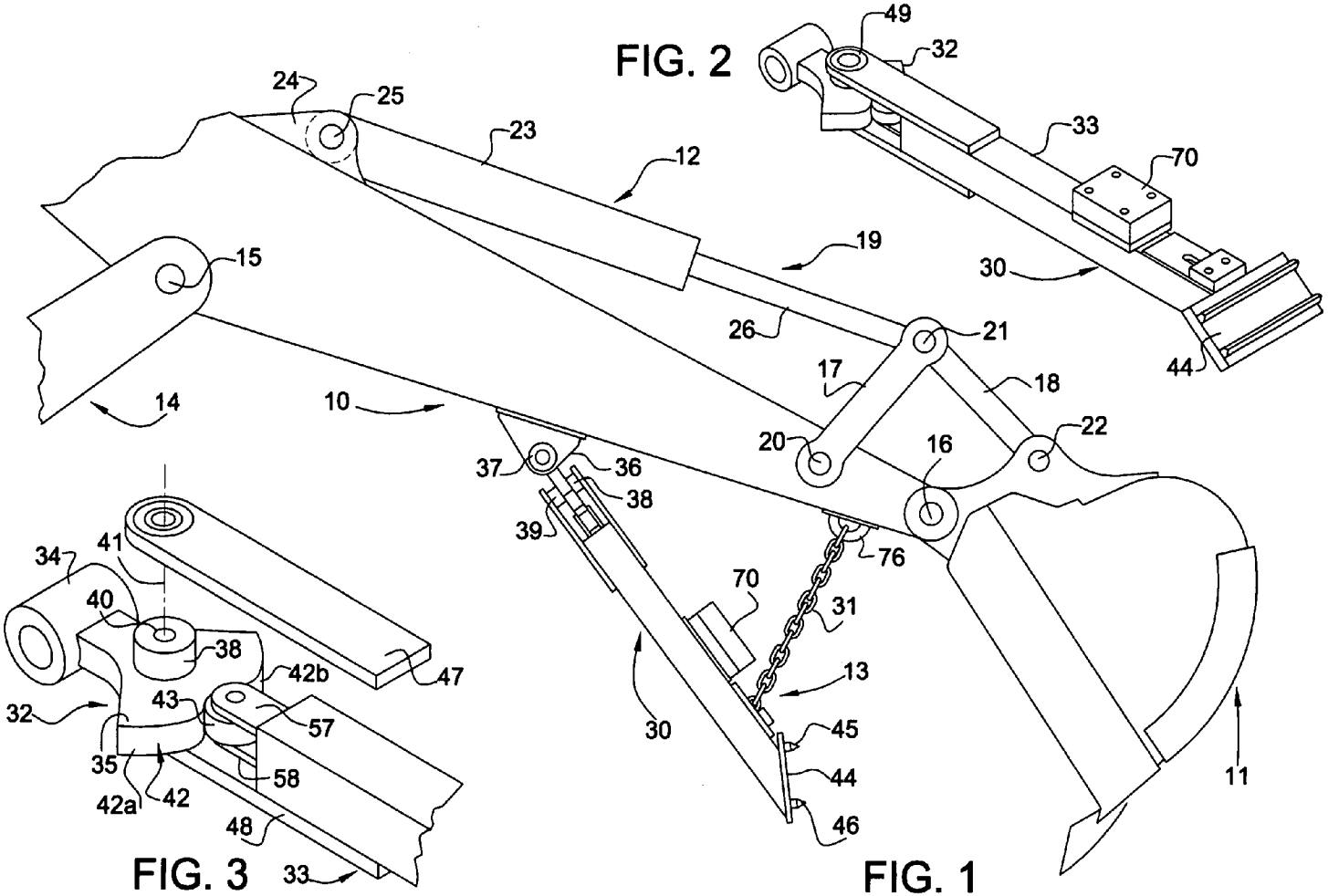
FIG. 1 is a side elevational view of the front end assembly of an excavating machine provided with an assembly embodying the present invention.
FIG. 2 is a perspective view of an arm member comprising a component of the assembly shown in FIG. 1.
FIG. 3 is an enlarged fragmentary view of a portion of the arm member shown in FIG. 2 illustrating a component thereof in exploded relation.
Figure 4:
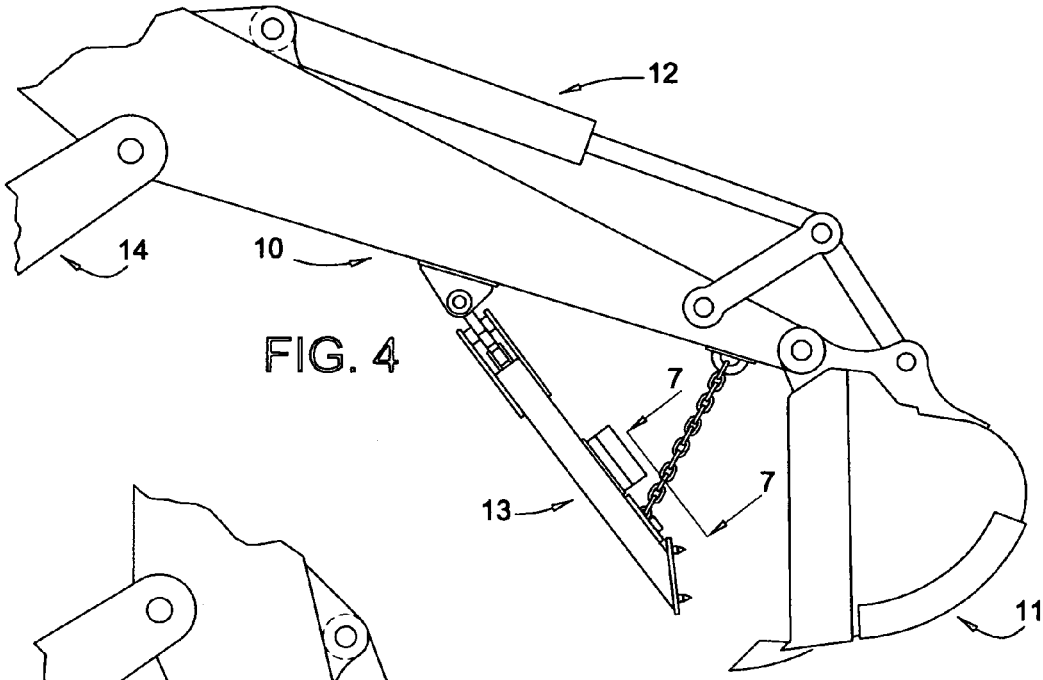
FIG. 4 is a view similar to the view shown in FIG. 1, illustrating the bucket in a curled position further advanced than the position shown in FIG. 1.

Referring to FIG. 1 of the drawings, there is illustrated a front end assembly of an excavating machine which generally includes a dipper stick 10, a bucket 11, a fluid actuated cylinder assembly 12 and a grappling assembly 13. Dipper stick 10 is pivotally connected to the free end of a boom 14 of the machine by means of a pinor set of pins 15 to permit the dipper stick to be pivoted about a substantially horizontal axis of pin or pins 15. The lower end of the boom is pivotally connected to the front end of the main frame of the machine, and a fluid actuated cylinder assembly operatively interconnects the boom and the upper end of the dipper stick for pivoting the dipper stick about the axis of connecting pin or pins 15. Similarly, one or more fluid actuated cylinder assemblies operatively interconnect the main frame of the machine and the boom for lifting and lowering the boom. Bucket 11 is pivotally connected to the free end of the dipper stick by means of a connecting pin 16. Cylinder assembly 12 also is of a conventional construction including a pair of support links 17, 17, a pair of tilt links 18, 18 and a hydraulic cylinder assembly 19. Support links 17, 17 are mounted on the side walls of the dipper stick adjacent connecting pin 16, by means of connecting pins 20, 20 and are connected at their free ends to a connecting pin 21. Tilt links 18, 18 are pivotally connected at one set of ends to connecting pin 21 and pivotally connected at the opposite ends thereof to bucket 11 at points spaced from connecting pin 16, by means of a connecting pin 22. Cylinder assembly 19 includes a cylinder member 23 connected at a base end thereof to a set of brackets 24, 24 mounted on the upper side of the dipper stick by means of a connecting pin 25, and a rod member 26 connected at its free end to connecting pin 21. Cylinder assembly 19 may be operated to curl and uncurl bucket 11 about the axis of connecting pin 16 by extending and retracting rod member 26 in the conventional manner.

Figure 6A:
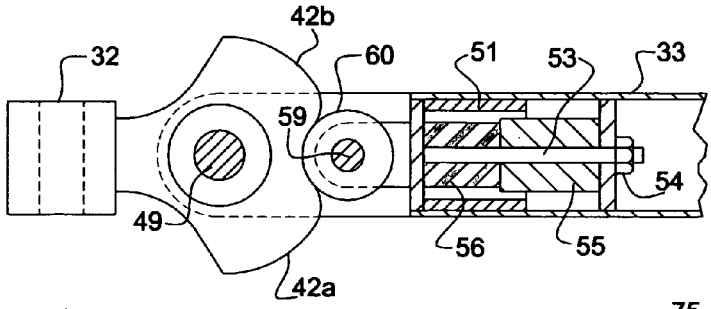
FIG. 6*a* is an enlarged cross-sectional view taken along line 6—6 in FIG. 5.
Figure 6B:
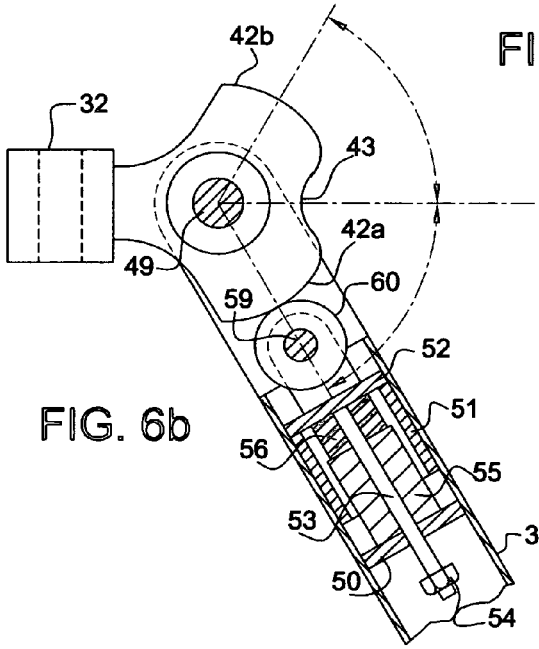
FIG. 6*b* is a view similar to the view shown in FIG. 6*a*, illustrating one of the arm sections displaced angularly relative to an adjoining arm section.

Arm assembly 13 includes an arm member 30 and a chain 31. Arm member 30 further consists of an upper arm section 32 pivotally connected to the underside of the dipper stick and a lower arm section 33 pivotally connected to the upper arm section. As best shown in FIGS. 3, 6*a* and 6*b*, the upper arm section is provided with a cylindrical portion 34 and a plate portion 35 projecting substantially radially from cylindrical portion 34. Portion 34 is received within a pair of depending brackets 36, 36 depending from the underside of dipper stick 10 and is pivotally connected thereto by means of a connecting pin 37. Mounted on the upper and lower surfaces of plate portion 35 are a pair of annular spacers 38 and 39 providing a connecting pin opening 40 having a axis 41 disposed perpendicular to a plane passing through the axis of cylindrical portion 34. The leading, free edge of plate member 35 is radially displaced relative to axis 41 providing a bearing surface 42 which further is provided with a notch or recess 43 at the center thereof forming a substantially undulating surface including notch 43 having a curved bottom wall and a pair of forwardly and outwardly curved side walls merging with radially displaced bearing surface portions 42*a* and 42*b* on opposite sides of the notch.

Lower arm section 33 is of an elongated box beam construction having rectangularly configured pad 44 rigidly secured on the free end thereof, lying in a plane angled relative to a longitudinal centerline of the lower arm member. Pad 44 is intended to cooperate with bucket 11 for grappling objects therebetween. To facilitate such gripping action, pad 44 is provided with a pair of spaced knife-like projections 45 and 46.

As best shown in FIGS. 3, 6*a* and 6*b*, the opposite end of the lower arm member is provided with upper and lower plate portions 47 and 48 rigidly secured on the upper and lower sides of the beam member and extending beyond the upper end of the beam member. The end portions of plate portions 47 and 48 engage spacers 38 and 39 and are connected thereto by means of a connecting pin 49, thus pivotally connecting lower arm member 33 to upper arm section 32 for pivotal movement about axis 41.

Referring to FIGS. 6*a* and 6*b*, a plate member 50 is provided in the upper end of arm section 33, spaced from the upper end thereof. Disposed within the upper end of arm section 33 is a cup-shaped member 51 having an end wall 52 displaceable longitudinally within the space between plate member 50 and the upper end of arm section 33. Secured to the inner side of end portion 52 of the cup-shaped member is an elongated bolt 53 disposed longitudinally relative to arm section 33, extending through an opening in plate member 50 and having a nut 54 threaded on the free end thereof. Disposed within member 51 and seated on plate member 50 is an annular spacer 55 receiving bolt 53 therethrough. Interposed between spacer 25 and end portion 52 of the cup-shaped member is a compressible elastomer 56 which functions to bias the cup-shaped member away from plate member 50, restrained by engagement of nut 54 with the inner side of plate member 50. Projecting from the outer side of end portion 52 of the displaceable cup-shaped member is a pair of ear portions 57 and 58, as best seen in FIG. 3, supporting a pin 59. Rotatably mounted on pin 59, receivable within notch 43 and ridable on bearing surface portions 42*a* and 42*b* is a roller 60 having an axis of rotation lying on the longitudinal centerline of arm section 33 and perpendicular to it.

The biasing mechanism of arm section 33, as described, functions to displaceably position roller 60 in notch 43 of bearing surface 42 under normal operating conditions to maintain arm section 33 longitudinally aligned with arm section 32 and correspondingly in cooperative alignment with bucket 11 to permit objects to be gripped between arm assembly 13 and the bucket. Upon application of a laterally directed force on the arm member, arm section 33 will be caused to angularly displace relative to arm section 32, as shown in FIG. 6*b*, roller 60 to ride on a bearing surface portion 42*a* or 42*b*, depending on the direction of the force applied, and cause elastomer 56 to compress and thus exert a greater force on roller 60. Upon removal of the laterally directed force on arm section 33, compressed elastomer 56 will exert a force on roller 60 causing it to ride toward and be repositioned in notch 43 to again longitudinally align arm section 33 with arm section 32. To enhance the camming action of bearing surface portions 42*a* and 42*b*, the radii of curvature of such surfaces relative to axis 41 may be made to increase in directions away from notch 43. Such increased radial displacements of bearing surface portions 42*a* and 42*b* will function to more positively cam roller 60 toward notch 43 to provide the desired alignment of the arm sections.

Figure 5:
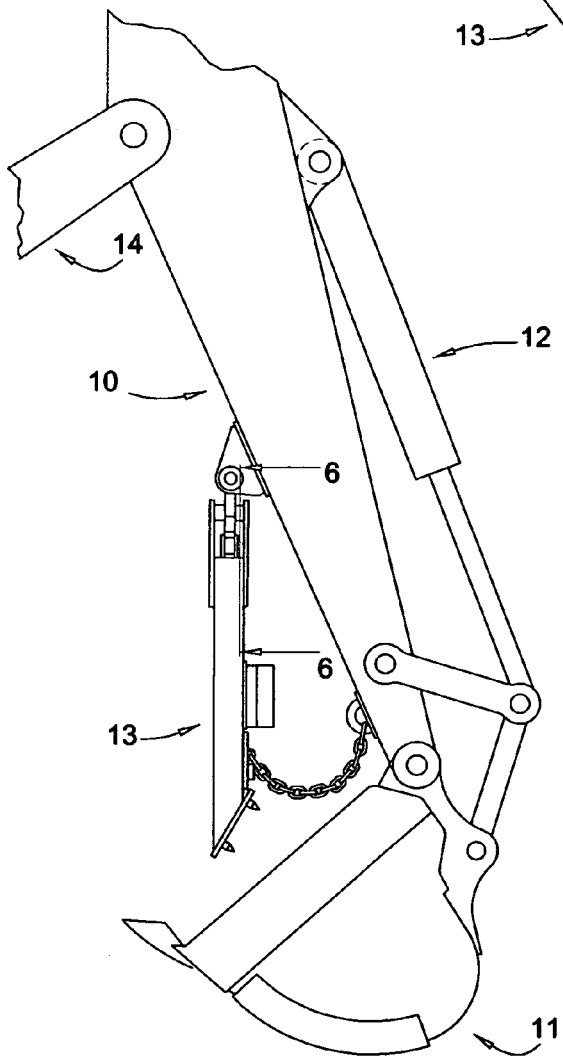
FIG. 5 is a view similar to the view shown in FIG. 4, illustrating the bucket in a still further advanced curled position.
Figure 7:
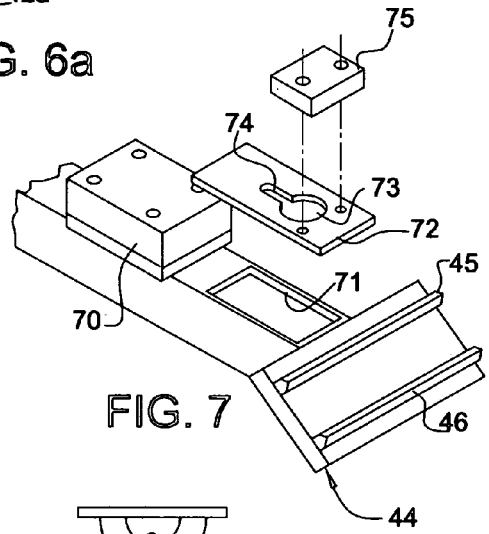
FIG. 7 is an enlarged cross-sectional view taken along line 7—7 in FIG. 4, illustrated in perspective and having components thereof shown in exploded relation.

Mounted on the upper portion of arm section 33, spaced from pad 46, is a bumper 70 formed of an elastomer material and engageable with the underside of the dipper stick whenever the dipper stick is angularly displaced in a substantially vertical position as shown being approached in FIG. 5. As shown in FIG. 7, in the space provided between bumper 70 and pad 46, the upper wall of arm section 33 is provided with an opening 71 adapted to be closed by a plate 72. Plate 72 is provided with a circular opening 73 having a radially extending slot 74. Opening 73 further is adapted to be closed by a retainer plate 75 which may be secured to plate member 72 by means of a set of bolts.

Figure 8:
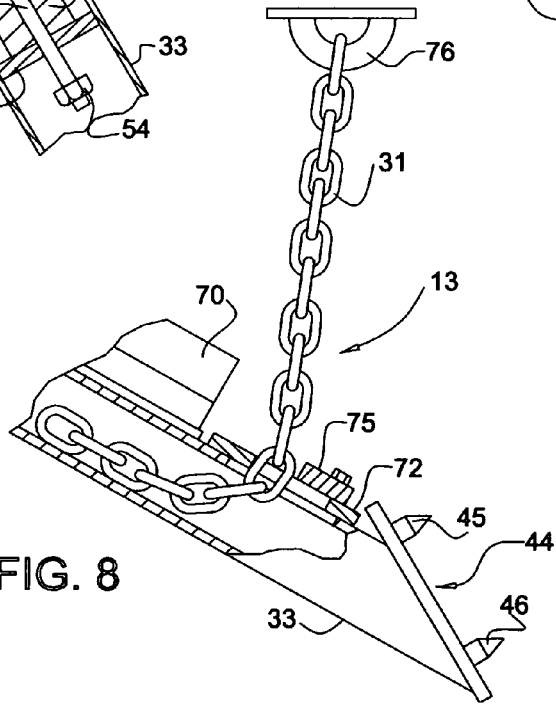
FIG. 8 is an enlarged view of a portion of the arm assembly shown in FIG. 1, having a portion thereof broken away.

The function of chain 31 is to extend and thus limit the angular displacement of the arm member relative to the dipper stick, provide a gripping component when extended and cooperating with bucket 11 and collapsing when the dipper stick is angularly displaced approaching a vertical position. One end of the chain is linked to a bracket 76 on the underside of the dipper stick and an opposite end of the chain is secured to the free end of arm section 33 by passing a link of the chain through opening 73 when retainer plate 75 is removed, inserting a link of the chain in slot 74 as shown in FIG. 8 and replacing retainer plate 75 to cover opening 73 and thus retain link in slot 74. To adjust the angular displacement of the arm member relative to the dipper stick, retainer plate 75 only needs to be removed, another chain link be inserted in slot 74 and the retainer plate replaced.

It is contemplated that the front end assembly as described may be used alternatively to excavate utilizing only the bucket or grapple utilizing a combination of the bucket and the arm assembly. When the assembly is used in the excavating mode, the arm assembly is not removed from the front end assembly. The length of the arm member intentionally is formed of a sufficient length to permit it to be received within the opening of the bucket as the bucket is curled during a normal digging operation.

In the grappling mode, objects being grappled may be seized between the bucket and the pad portion of the arm assembly, the bucket and the chain in its extended condition or between the bucket and the chain and pad together.

Although the front end assembly described utilizes a bucket as in an excavating machine, it should be understood that any type of tool may be used within the scope of the invention which is functional to cooperate with the arm assembly to grapple objects therebetween. In addition to the tool constituting a bucket, it also may consist of a grapple, a rake a fork and the like.

In the use of the arm assembly to grapple an object such as a tree trunk, with the bucket in an uncurled position, the boom and dipper stick are maneuvered to cause chain 31 and pad portion 44 to engage a side of the trunk. Cylinder assembly 12 is then operated to curl the bucket and thus grip the tree trunk between the arm assembly and the bucket. The boom and dipper stick may then further be maneuvered to transport the gripped tree trunk to a selected location where the bucket may be uncurled to release and thus deposit the tree trunk at the selected location. In performing such operations, the length of chain 31 may be adjusted as previously described. In switching to a digging mode, no removal or adjustment of the arm assembly is required in that such assembly will not interfere with the normal curling and uncurling of the bucket as it performs a digging operation.

Whenever any lateral forces are imposed on the lower arm section to misalign the arm member with the bucket, the biasing mechanism in the lower arm section will function automatically to realign the lower end section with the bucket in the manner as previously described.

From the foregoing detailed description, it will be evident that there are a number of changes, adaptations, and modifications of the present invention which come within the province of those persons having ordinary skill in the art to which the aforementioned invention pertains. However, it is intended that all such variations not departing from the spirit of the invention be considered as within the scope thereof as limited solely by the appended claims.

I claim:

1. An assembly mountable on the boom of a machine for grappling objects, comprising:

a dipper stick pivotally connectable to said boom;

a tool connected to said dipper stick, pivotal about a first axis relative to said dipper stick;

means operatively interconnecting said dipper stick and said tool for pivoting said tool about said first axis;

an arm member having a first section connected to an underside of said dipper stick for pivotal movement about a second axis and a second section connectable to said first arm section for pivotal movement relative to said first arm section about a third axis, one of said arm sections having a curved bearing surface with a notch therein and the other of said arm sections having a biased roller engaging said bearing section whereby said roller may be received in said notch to displaceably position said second arm section relative to said first arm section, and ride on portions of said curved surface when a force in a certain direction is applied to said second arm section; and a chain connected at one end to said underside of said dipper stick and connected at another end thereof to said arm member, whereby when said assembly is operated in a grappling mode, objects may be grappled by maneuvering said chain in an extended condition against a side of an object and then pivoting said tool to sieze said object between said chain and said tool.

2. An assembly according to claim 1 wherein said second arm section is provided with a pad on the free end thereof which may engage an object being grappled.

3. An assembly according to claim 1 wherein said arm member is provided with a bumper engageable with said underside of said dipper stick.

4. An assembly according to claim 1 wherein when said tool comprises a bucket which may be curled about said second axis toward the underside of said dipper stick, and said arm member has a length sufficient to be received within a material receiving opening of said bucket.

5. An assembly according to claim 1 wherein said bearing surface has an undulating configuration.

6. An assembly according to claim 1 wherein said notch is disposed on a longitudinal centerline of one of said arm sections, and the axis of rotation of said roller lies on the longitudinal centerline of the other of said arm sections.

7. An assembly according to claim 6 wherein said bearing surface has an undulating configuration.

8. An assembly according to claim 1 wherein said notch is disposed on the longitudinal centerline of said first arm member, and the axis of rotation of said roller is disposed on the longitudinal centerline of said second arm section.

9. An assembly according to claim 8 wherein said bearing surface has an undulating configuration.

10. An assembly according to claim 8 wherein said roller is biased along a line of travel aligned with the longitudinal centerline of said second arm section.

11. An assembly according to claim 1 wherein said portions of said bearing surface disposed on sides of said notch are radially displaced relative to said third axis.

12. An assembly according to claim 1 wherein said portions of said bearing surface disposed on sides of said notch have increasing radii of curvature from said notch laterally, relative to said third axis.

13. An assembly mountable on a dipper stick of a machine, having a tool pivotally connected thereto and means operatively interconnecting said dipper stick and said tool for pivoting said tool relative to said dipper stick about a first axis, cooperable with said tool when mounted on said dipper stick for grappling objects comprising:

an arm member having a first section connectable to an underside of said dipper stick for pivotal movement about a second axis and a second section connectable to said first section for pivotal movement relative to said first arm section about a third axis, one of said arm members having a curved bearing surface with a notch therein and the other of said arm sections having a roller biased against said bearing surface whereby said roller may be received in said notch to displaceably position said second arm section relative to said first arm section in a certain relationship and ride on portions of said curved bearing surface when a force in a certain direction is applied to said second arm section causing said roller to ride out of said recess against the biasing force acting thereon; and a chain connected at one end to said second arm section and connectable at an opposite end thereof to said dipper stick.

14. An assembly according to claim 13 wherein said second arm section is provided with a pad on a free end thereon which may engage an object being grappled.

15. An assembly according to claim 13 wherein said arm member is provided with a bumper engageable with said underside of said dipper stick.

16. An assembly according to claim 13 wherein said tool comprises a bucket which may be curled about said second axis toward the underside of said dipper stick, and said arm member has a length sufficient to be received within a material receiving opening of said bucket.

17. An assembly according to claim 13 wherein said bearing surface has an undulating configuration.

18. An assembly according to claim 13 wherein said notch is disposed on a longitudinal centerline of one of said arm sections, and the axis of rotation of said roller lies on a longitudinal centerline of the other of said arm sections.

19. An assembly according to claim 18 wherein said bearing surface has an undulating configuration.

20. An assembly according to claim 13 wherein said notch is disposed on the longitudinal centerline of said first arm section, and the axis of rotation of said roller is disposed on the longitudinal centerline of said second arm member.

21. An assembly according to claim 20 wherein said bearing surface has an undulating configuration.

22. An assembly according to claim 20 wherein said roller is biased along a line of travel aligned with the longitudinal centerline of said second arm section.

23. An assembly according to claim 13 wherein said portions of said bearing surface disposed on sides of said notch are radially displaced relative to said third axis.

24. An assembly according to claim 13 wherein said portions of said bearing surface disposed on sides of said notch have increasing radii of curvature from said notch laterally, relative to said third axis.

25. An assembly according to claim 13 wherein said biasing of said roller is provided by a compressible elastomer disposed between one of said arm members and said roller.

26. An assembly according to claim 13 wherein said chain is connectable to said second arm section at selected points along its length to vary the length thereof.

* * * * *